US006292957B1

(12) United States Patent
Thompson

(10) Patent No.: US 6,292,957 B1
(45) Date of Patent: Sep. 25, 2001

(54) SHOWER CURTAIN RETAINER ASSEMBLY

(76) Inventor: Paul E. Thompson, 73 Orchard St., Webster, NY (US) 14580

( * ) Notice: Subject to any disclaimer, the term of this patent is extended or adjusted under 35 U.S.C. 154(b) by 0 days.

(21) Appl. No.: 09/633,731

(22) Filed: Aug. 7, 2000

(51) Int. Cl.[7] ..... A47K 3/22
(52) U.S. Cl. ..... 4/609; 24/303
(58) Field of Search ..... 4/558, 559, 608, 4/609, 610; 24/303

(56) References Cited

U.S. PATENT DOCUMENTS

| | | | | |
|---|---|---|---|---|
| 2,864,096 | * | 12/1958 | Garber | 4/608 X |
| 3,000,016 | * | 9/1961 | Ridge | 4/608 X |
| 3,282,328 | * | 11/1966 | Mushro et al. | 4/608 X |
| 3,365,684 | * | 1/1968 | Stemke et al. | 4/608 X |
| 5,682,653 | * | 11/1997 | Berglof et al. | 24/303 |
| 5,953,771 | * | 9/1999 | Van Huss | 4/609 |
| 6,101,688 | * | 8/2000 | Marchesi | 24/303 |
| 6,226,842 | * | 5/2001 | Wong | 24/303 |

* cited by examiner

*Primary Examiner*—Charles E. Phillips

(74) *Attorney, Agent, or Firm*—Fred L. Denson

(57) ABSTRACT

A shower curtain retainer assembly for retaining the bottom of a shower curtain against a shower enclosure wall is described. The assembly includes a first set of plastic disks, a second set of plastic disks and a set of magnetically responsive plates. A magnet is encased in each plastic disk. The magnetically responsive plates are attached to the inside wall of the shower enclosure that is adjacent to the bottom of the shower curtain. The first set of plastic disks are positioned on the front face of the shower curtain and are aligned with the positions of the magnetically responsive plates. The second set of plates are positioned on the back face of the curtain in juxtaposition with the first set of plastic disks. The first and second sets of plastic disks are held in place by magnetic attraction forces from the magnets encased in the disks. When the shower curtain is closed, the first set of plastic disks become magnetically attached to the magnetically responsive plates. Because the bottom of the shower curtain is interposed between the first and second sets of plastic disks, it becomes secured against the shower enclosure wall. A variation of the invention includes attaching the magnetically responsive plates to part of the top side of a shower mat which extends over the base and wall of the shower enclosure. The bottom side of the mat is secured by suction cups to the base and wall which also enhances user safety.

8 Claims, 18 Drawing Sheets

SECTION A - A

SECTION B - B

SHOWER CURTAIN RETAINER ASSEMBLY

BACKGROUND OF THE INVENTION (1) Field of the Invention

This invention relates to shower curtains in general and in particular to a retainer assembly for holding the bottom of a shower curtain against a shower enclosure wall while a shower is in use. The invention also relates to a shower curtain retainer assembly that includes a shower mat with safety features to protect the user against slipping.

(2) Description of the Prior Art

When a shower is in use, air currents usually cause the bottom of a pliable shower curtain to move inward from its natural hanging position against the bottom inside wall of a shower enclosure while a shower is in use. This not only causes an annoyance for to user, but also allows water to escape onto floor areas outside of the shower enclosure. Efforts have been made to overcome this problem by placing weights at the bottom of the curtain. While this has helped to alleviate the problem in some instances, the use of weights has not always resulted in the bottom of a curtain remaining firmly in place. The utilization of magnetic weights also helped to further alleviate the problem at a time when shower enclosures were used with cast iron bath tubs. However, the replacement of cast iron tubs with tubs and shower enclosure units made from fiberglass and other synthetic materials has exasperated the problem. The prior art outlined herein describes some of the efforts that have been made to address this situation. The prior art also describes some ways that have been used to improve shower safety and convenience.

U.S. Pat. No. 4,090,265 by Baus describes a partition wall for wet chambers, including bathrooms and stall showers. The wall panels slide relative to each other and have magnets installed in the lower guide ledges for holding and guiding each wall panel.

U.S. Pat. No. 4,098,318 by Ruegsegger describes a curtain edge retainer for securing and releasing a marginal edge portion of a pliant hanging curtain parallel to the shower walls. The shower curtain has a ridged curtain stiffener attached to it by means of clip-on members. The wall section of the device is permanently attached to the wall and has a latching member. The latch member on the wall receives and latches onto the rigid curtain stiffener.

U.S. Pat. No. 4,197,616 by Panuski describes a shower curtain retainer which is a clamping device. The device uses the tension of a flat spring steel clamping strip to hold a shower curtain against a bathroom wall.

In U.S. Pat. No. 4,594,741 by Payne, elongated strip magnets are secured permanently to opposing walls of the shower enclosure and elongated strip magnet assemblies are secured to each side of the shower curtain. The magnetic attractions of the curtain magnets to the wall magnets secure the shower curtain in a closed position.

U.S. Pat. No. 4,888,835 by Baumann describes a splashguard for a bathtub comprised of a flat rectangular panel member. The splashguard is movably suspended from an adjustable-length guide rail. At least one magnet is permanently attached to the bathtub (if the tub is not metal) and one to the panel member. The magnetic attraction of the panel to the tub secures the lower section of the panel.

U.S. Pat. No. 5,551,101 by Leach describes a bath mat that provides a portable device for converting a bathtub into a safe, more user friendly environment for bathing infants/preschoolers or individuals with impaired mobility. The bath mat catches fluids that splash over the top rim of the bathtub. A padded surface that covers the top rim of the bathtub eases discomfort of the parent or care giver who lean over the bathtub.

U.S. Pat. No. 5,809,589 by Johnson discloses a shower curtain retaining device to hold the curtain away from the person using the shower. Suction cup attachments are secured on each side of the shower stall opening and a spring assembly is attached to one suction cup attachment. A line is attached at one end of the spring, the other end of the line is attached to the other attachment. A device is provided which can be attached adjacent to the curtain and retain the curtain away from a person using the shower.

While each invention described in the prior accomplished intended purposes, each is accompanied by disadvantages. U.S. Pat. No. 4,090,265 uses magnets to retain the bottom of the shower partitions but its components are complicated with many being permanently attached to the shower enclosure. U.S. Pat. No. 4,098,318 uses magnets to retain the bottom of the shower partition, but if the shower enclosure is not metal, a metal strip must be permanently attached to the shower enclosure. Although the shower partition is not permanent, its size and shape prevent it from being easily transported. U.S. Pat. No. 4,594,741 uses magnets to retain the shower curtain to each side of the shower enclosure. This method of retaining the shower curtain does very little to retain the bottom of the shower curtain from contacting an individual using the shower. To practice the invention, magnetic strips must be permanently attached to the shower walls or shower enclosure walls. U.S. Pat. No. 4,098,318 and U.S. Pat. No. 4,197,616 both use mechanical means to retain the shower curtain to each side of the shower enclosure. This method of retaining a shower curtain does very little to retain the bottom of the curtain from contacting an individual using the shower. Also, components in both designs must be permanently attached to the shower walls or shower enclosure walls. U.S. Pat. No. 5,809,589 uses mechanical means to retain a shower curtain at its bottom but the system has components that may serve to trip individuals on entering or exiting the shower enclosure or present a potential danger for the entanglement of small children. The special bath mat described in U.S. Pat. No. 5,551,101 has no means for retaining a shower curtain to its surface.

It is therefore an object of this invention to provide a new and improved shower curtain retaining assembly that is easy to use, lightweight and not permanently affixed to either the shower enclosure or curtain thereby making the system readily transportable.

It is also an object of this invention to provide a shower curtain retaining assembly that includes a new and improved safety mat for use with a shower enclosure.

The present invention is designed to overcome the disadvantages of the prior art.

SUMMARY OF THE INVENTION

In accordance with the present invention, a shower curtain retainer assembly is described which includes a set of magnetically responsive plates, a first set of plastic disks having a magnet encased in each disk and a second set of plastic disks also having a magnet encased in each shower curtain by disk. When put to use, the set of magnetically responsive plates is attached to the part of the shower enclosure wall that is adjacent to the bottom part of a shower curtain. The first set of plastic disks are positioned on the front face of the shower curtain and are aligned to mate with the magnetically responsive plates when the curtain is closed. The second set of plastic disks are positioned on the back face of the shower curtain in juxtaposition with the first set of plastic disks. The shower curtain is interposed between the first and second sets of plastic disks which are held in place by magnetic attraction. The facing surfaces of any two adjacent magnetically responsive components have opposite polarity so that they are retained in place.

When the shower curtain is closed, the first set of plastic disks becomes magnetically attached to the set of magnetically responsive plates positioned on the inside wall of the shower enclosure. Because the shower curtain is captured between the first and second sets of plastic disks, it is held in place against the inside wall of the shower enclosure. When the curtain is opened, the pulling force used for opening the curtain is greater than the magnetic force of attraction between the plates and the first set of plastic disks. This causes the first set of disks to become detached from the plates. However, the first set of disks remain in place on the front face of the curtain because their magnetic attraction to the second set of disks is greater than their magnetic attraction to the plates.

The magnetically responsive plates can be placed directly on the inside wall of a shower enclosure or they can be encased in a shower mat which is attached to the inside wall by suction cups. The mat can optionally be extended over the bottom and/or over the sides of the enclosure wall to provide an extended non slip surface for persons entering or exiting the shower.

The invention, its objects and advantages will become more apparent in the detailed description of the preferred embodiment presented below.

DETAILED DESCRIPTION OF THE PREFERRED EMBODIMENTS

Figure 1A:
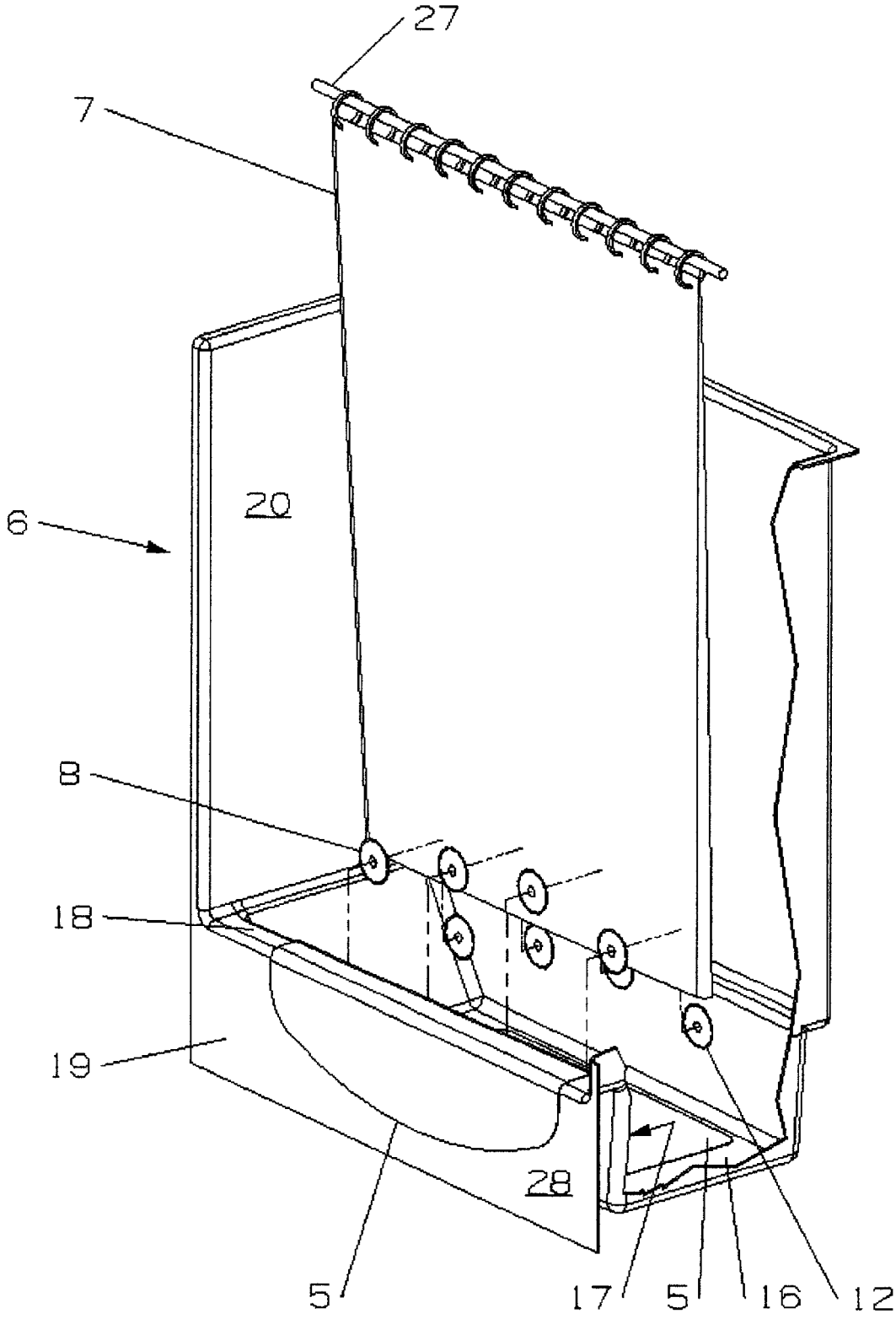
FIG. 1*a* is a front perspective view of a shower enclosure with the shower curtain retainer of this invention.
Figure 1B:
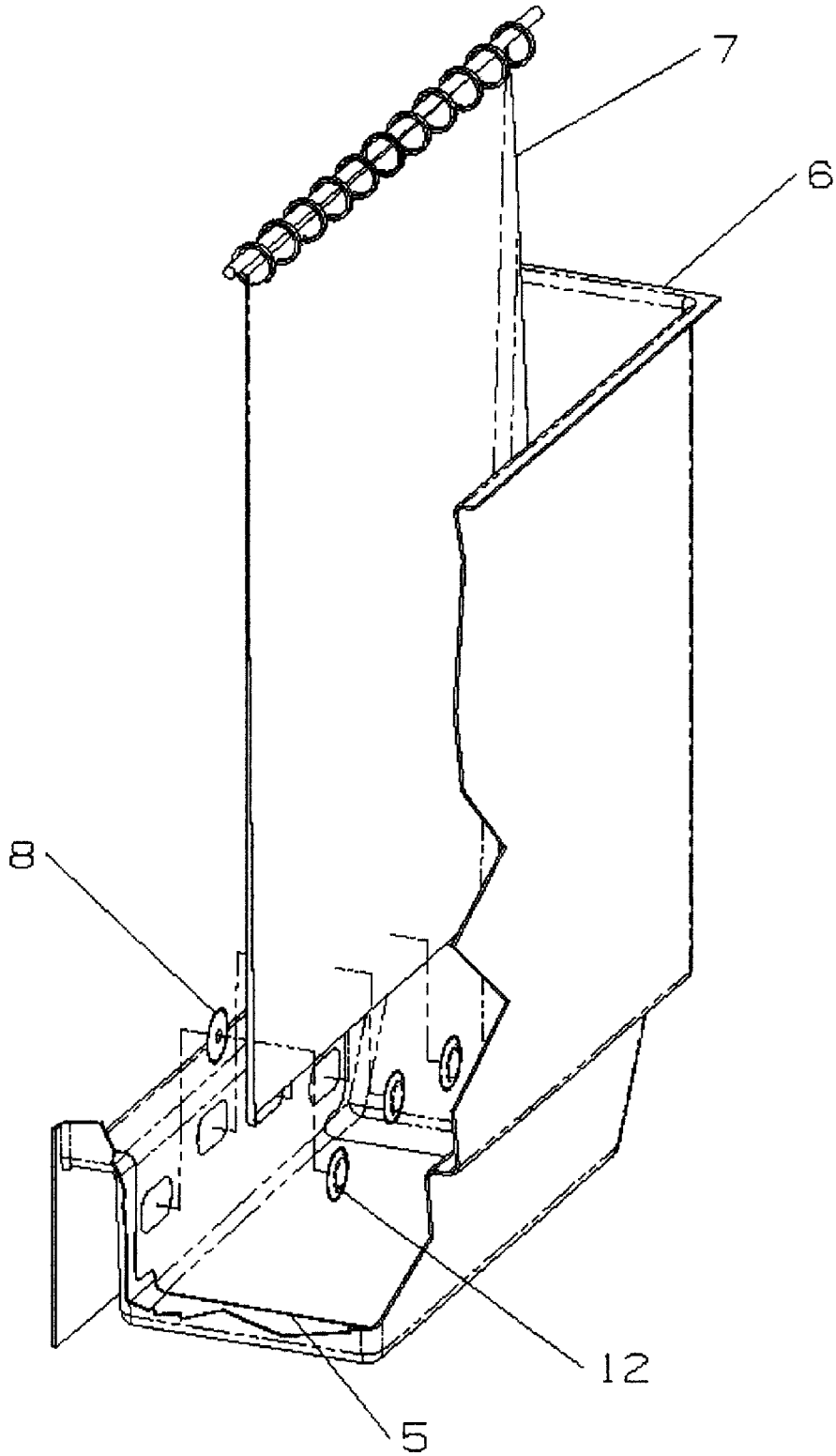
FIG. 1*b* is a rear perspective view of a shower enclosure with the shower curtain retainer of this invention.
Figure 1C:
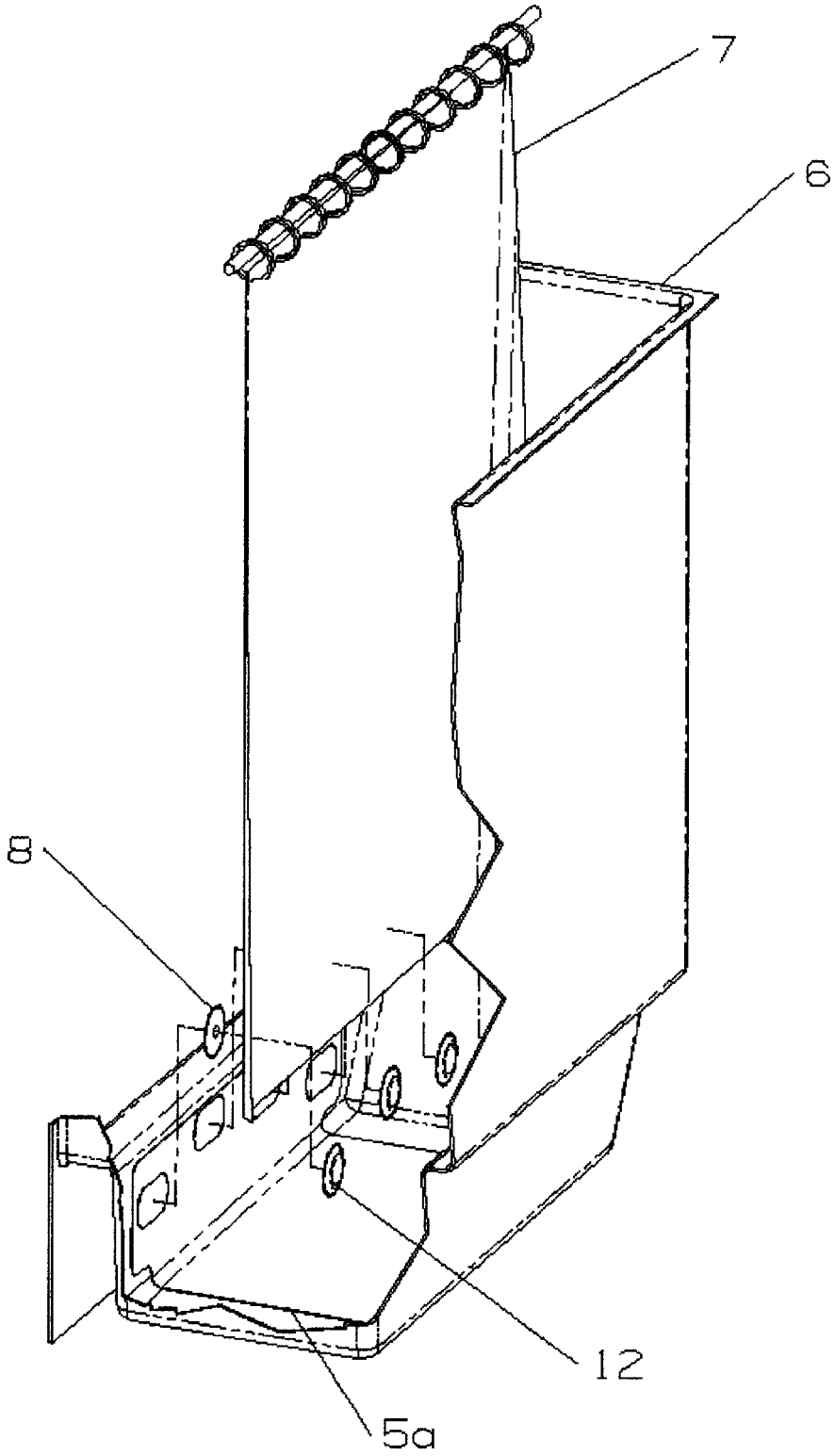
FIGS. 1*c,* 1*d* and 1*e* are rear perspective views of a shower enclosure with alternative embodiments of the shower curtain retainer of this invention.
Figure 1D:
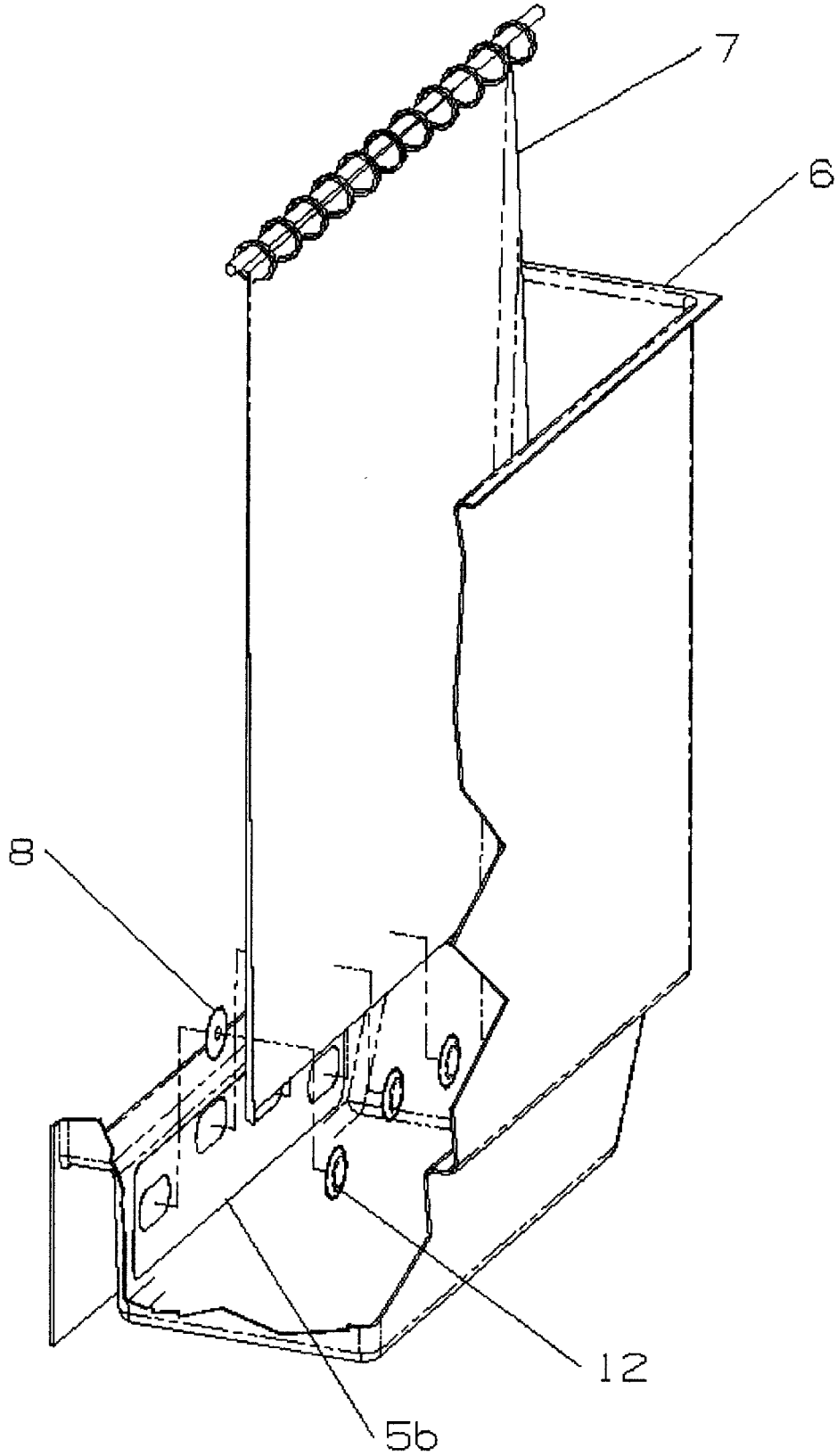
Figure 1E:
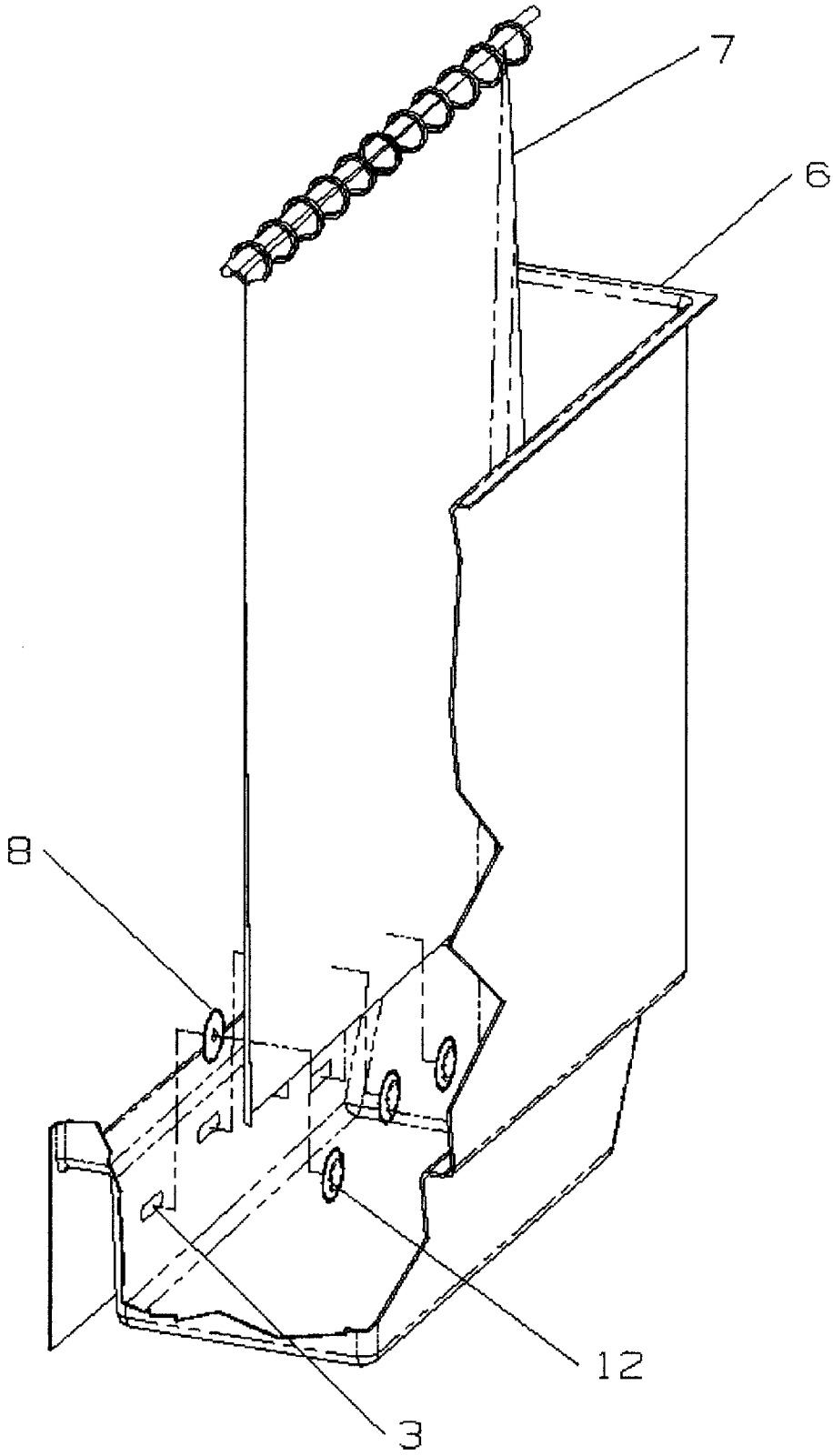
Figures 2A, 2B, 2C:
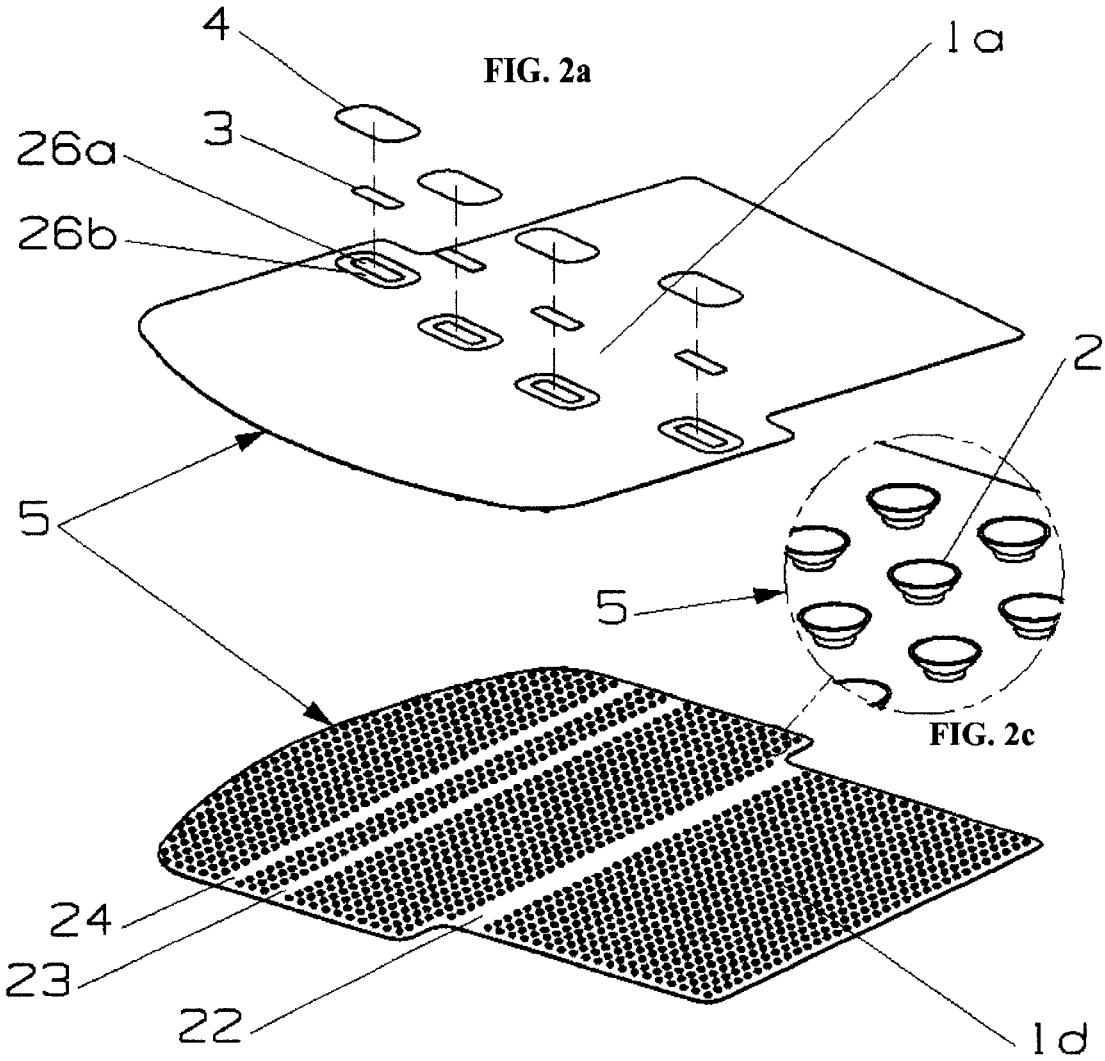
FIGS. 2*a,* 2*d* and 2*g* are top perspective views of tub mats.
FIGS. 2*b,* 2*e* and 2*h* are bottom perspective views of the tub mats of FIGS. 2*a*, 2*d* and 2*g* respectively.
FIGS. 2*c,* 2*f* and 2*i* are exploded views of the indicated parts of FIGS. 2*b,* 2*e* and 2*h* respectively.
Figures 2D, 2E, 2F:
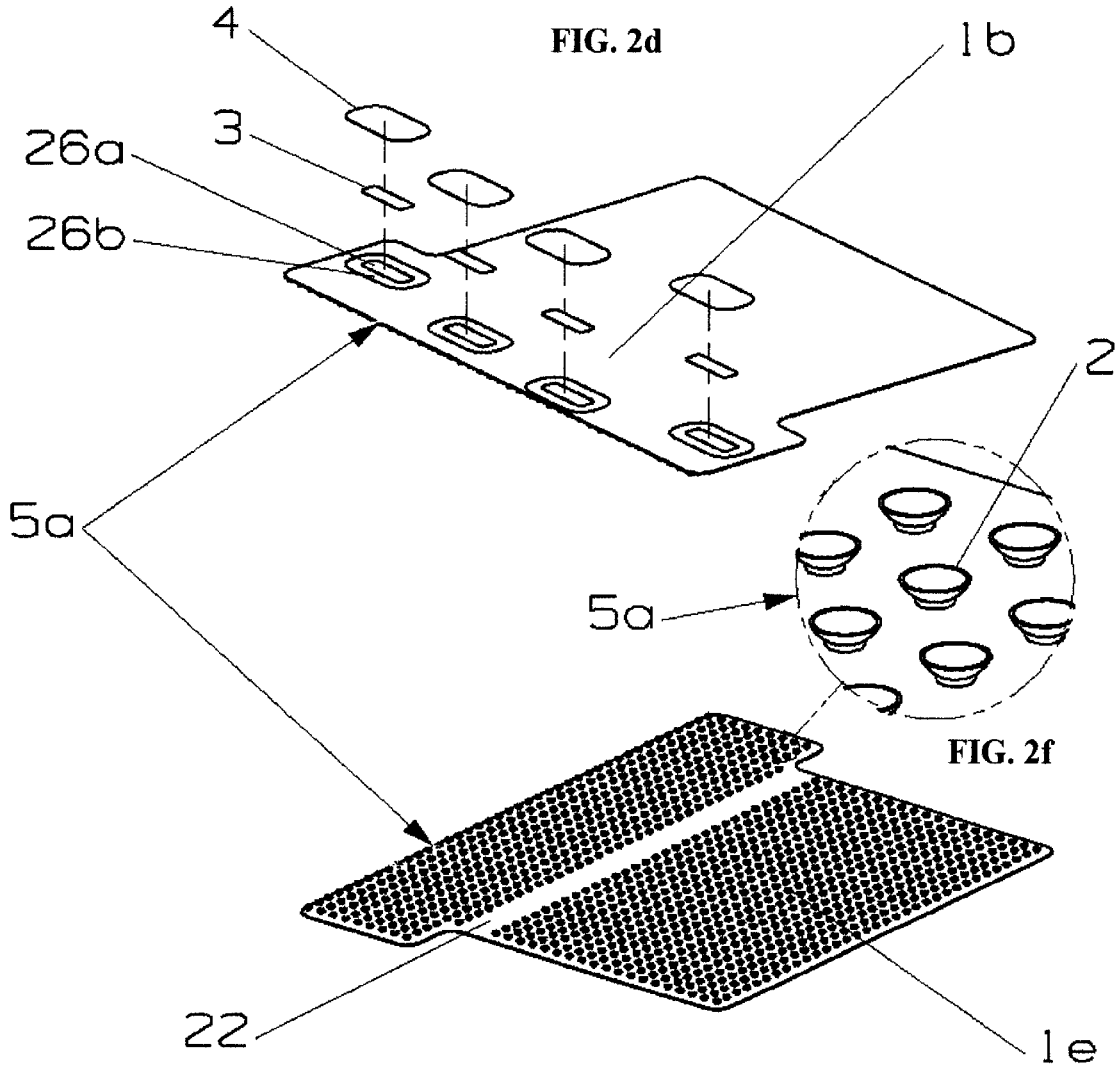
Figures 2G, 2H, 2I:
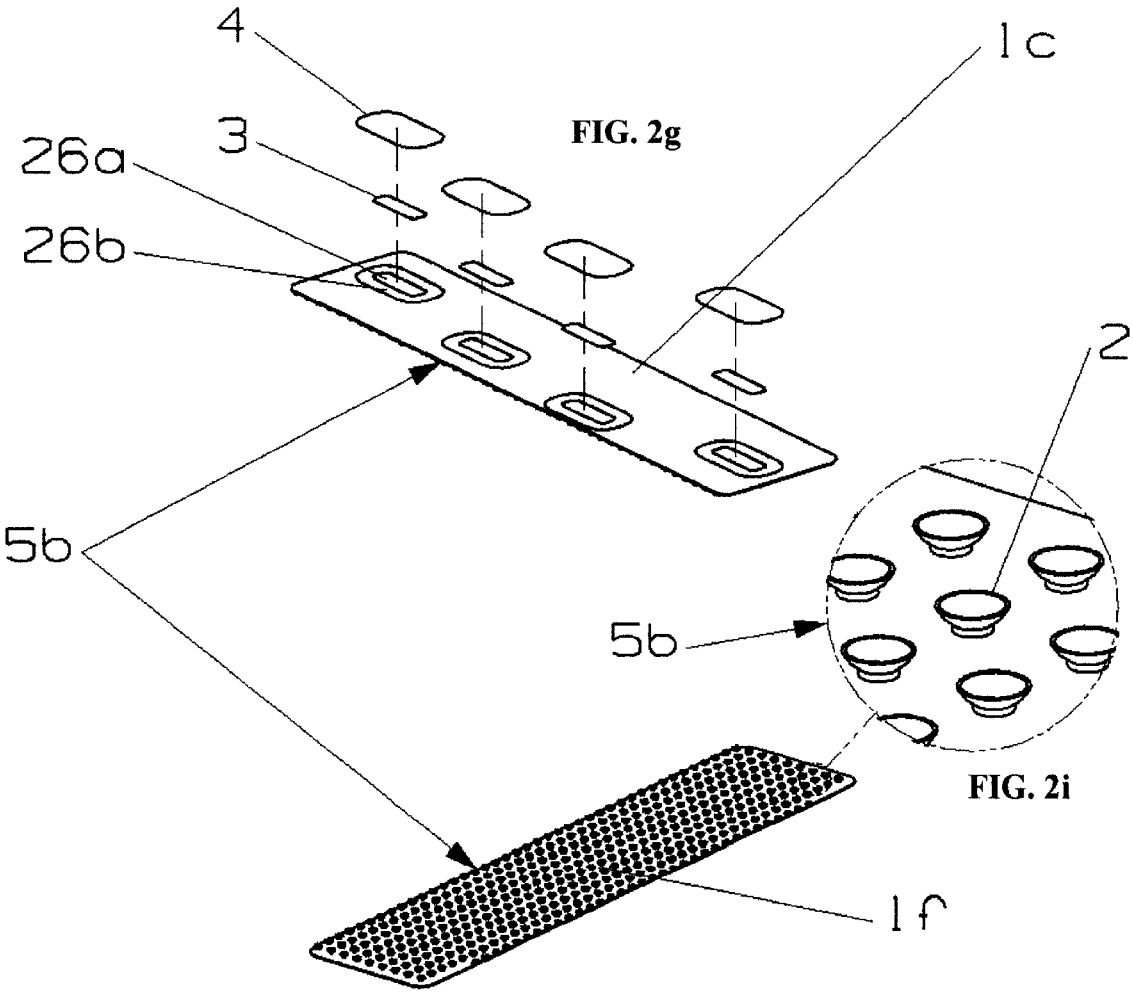

As shown in FIGS. 1*a,* 1*b*, 1*c*, 1*d* and 1*e* collectively, shower enclosure 6 includes wall 20 and tub 28 having bottom 16, inside wall 17, top wall 18 and outside wall 19. Shower curtain 7 is suspended from rod 27. The bottom portion of shower curtain 7 is retained against inside wall 17 by a retainer assembly which includes a plurality of magnetically responsive plates 3 (FIG. 1*e*), first plastic disks 8 and second plastic disks 12. Each of the plastic disks 8 and 12 has a magnet encased therein. Plates 3 are made from any magnetically responsive material but preferably consist of a thin, resilient magnetically responsive material ranging in thickness from about 5 mils to about 25 mils. Plates 3 are directly attached to tub inside wall 17 with a bonding adhesive as shown in FIG. 1*e*. Plates 3 may also be attached to a substrate or carrier which is positioned on tub inside wall 17 (FIGS. 1*b*, 1*c* and 1*d*). As shown in FIGS. 2*a*, 2*b* and 2*c*, plates 3 are disposed in a plurality of pockets 26*a* positioned on the topside of mat 5. Cover 4 is positioned in recess 26*b* which surrounds the upper part of pocket 26*a*, the depth of pocket 26*a* being greater than the depth of recess 26*b* below surface 1*a*. Cover 4 is secured to recess 26*b* by any suitable adhesive in a manner such that plate 3 is completely covered.

A plurality of suction cups 2 are positioned on the bottom side 1*d* of mat 5. There are no suction cups in fold areas 22, 23 and 24 since these areas define sections of the mat which correspond to places where bottom 16, inside wall 17, top wall 18 and outside wall 19 of tub 28 converge with adjoining surfaces which require bending of the mat as shown in FIGS. 1*a* and 1*b*. Suction cups 2 secure mat 5 against these surfaces to ensure that the mat remains in position. Because mat 5 extends over surfaces used by individuals when entering or exiting a shower enclosure, it creates a non-slip area that enhances the safety of such individuals. As shown in FIGS. 1*c*, 2*d*, 2*e* and 2*f*, plates 3 can be attached to mat 5*a* which is similar to mat 5 except that it is attached only to the bottom and inside wall of the shower enclosure. Another variation is shown in FIG. 1*d*, 2*g*, 2*h* and 2I which detail the positioning of plates in mat 5*b* which is attached only to the inside wall of the shower enclosure by suction cups 2.

Figure 3A:
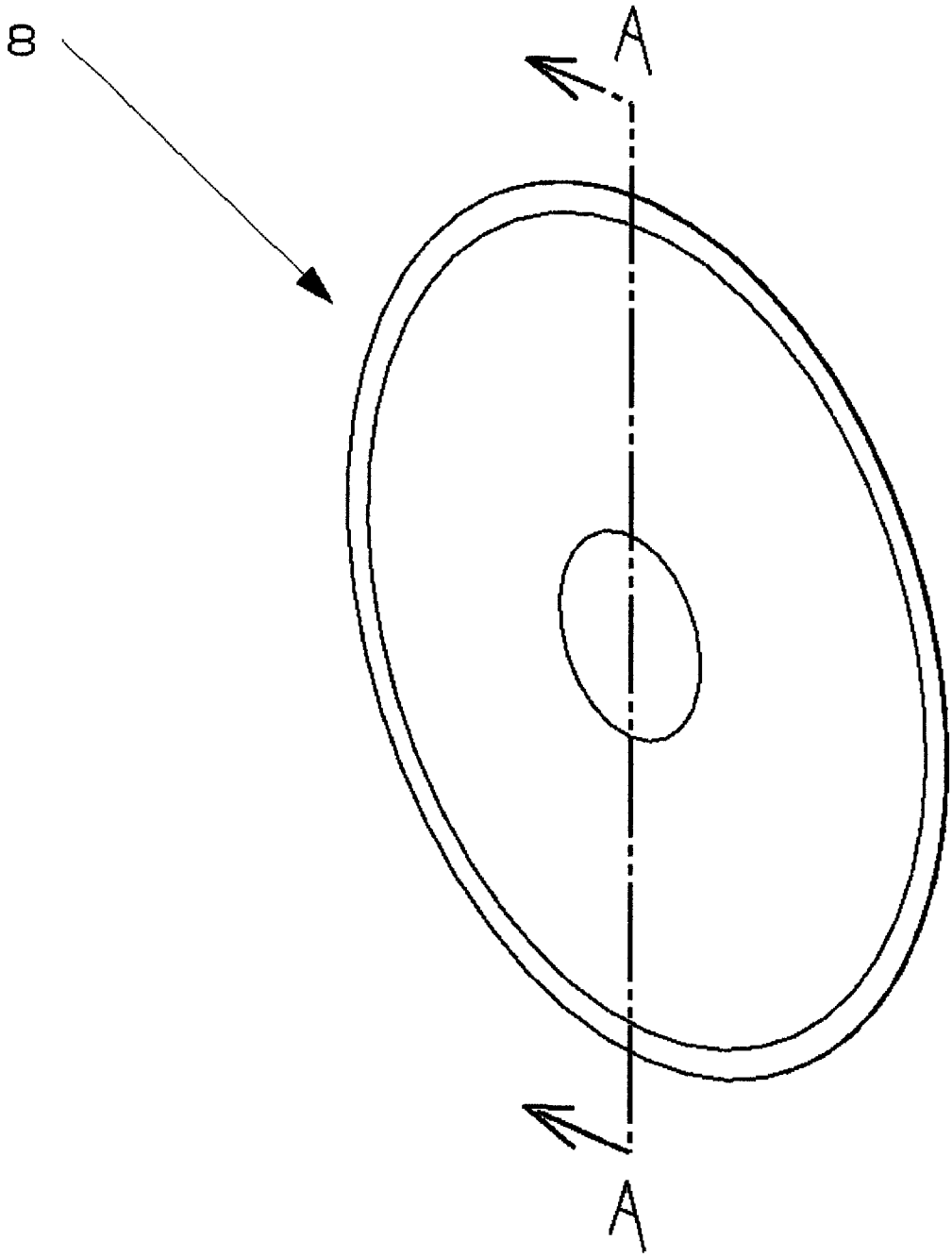
FIGS. 3*a* and 3*b* are perspective views of the plastic disks which are part of the shower curtain retainer of this invention.
Figure 4A:
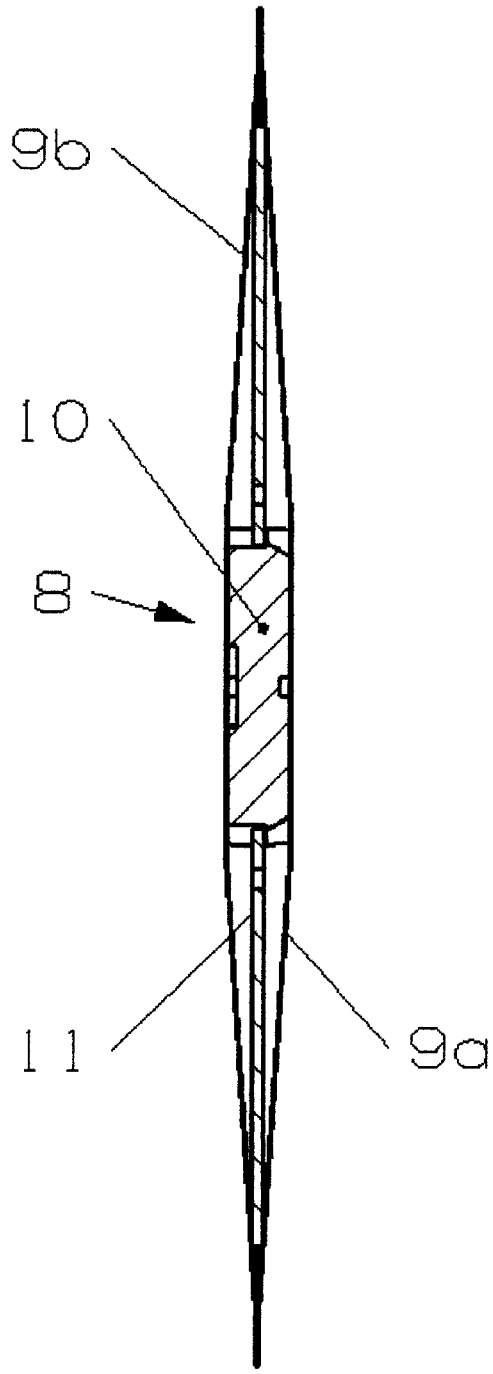
FIG. 4*a* is the A—A section view of FIG. 3*a*.
Figure 4B:
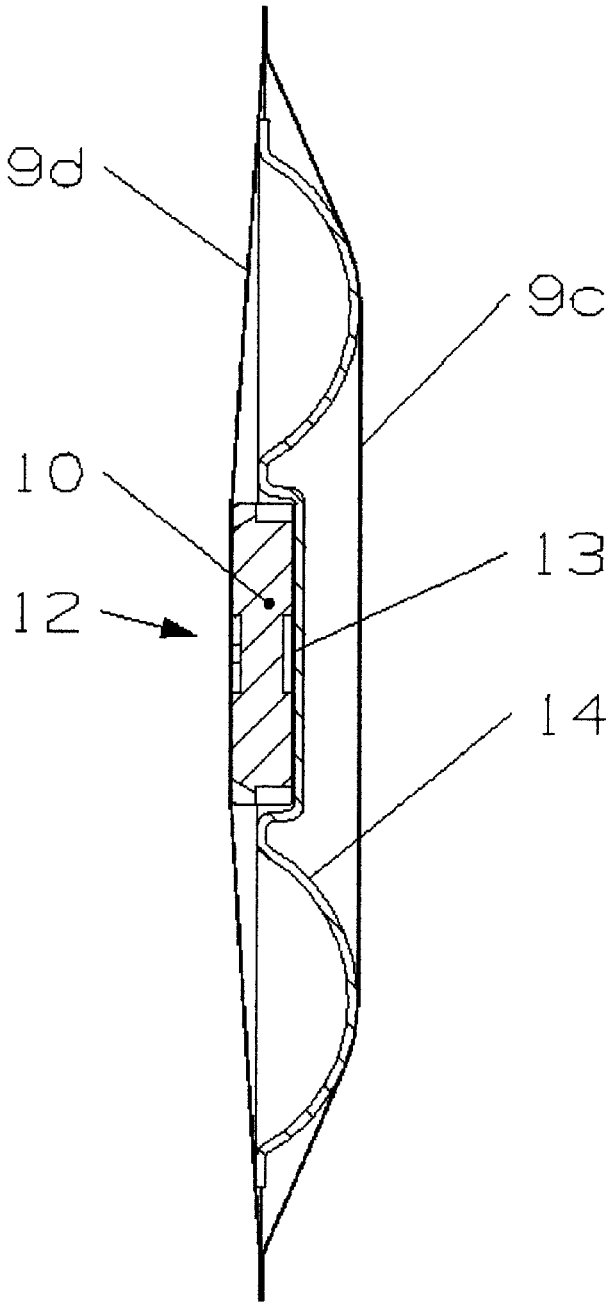
FIG. 4*b* is the B—B section view of FIG. 3*b*.
Figure 5A:
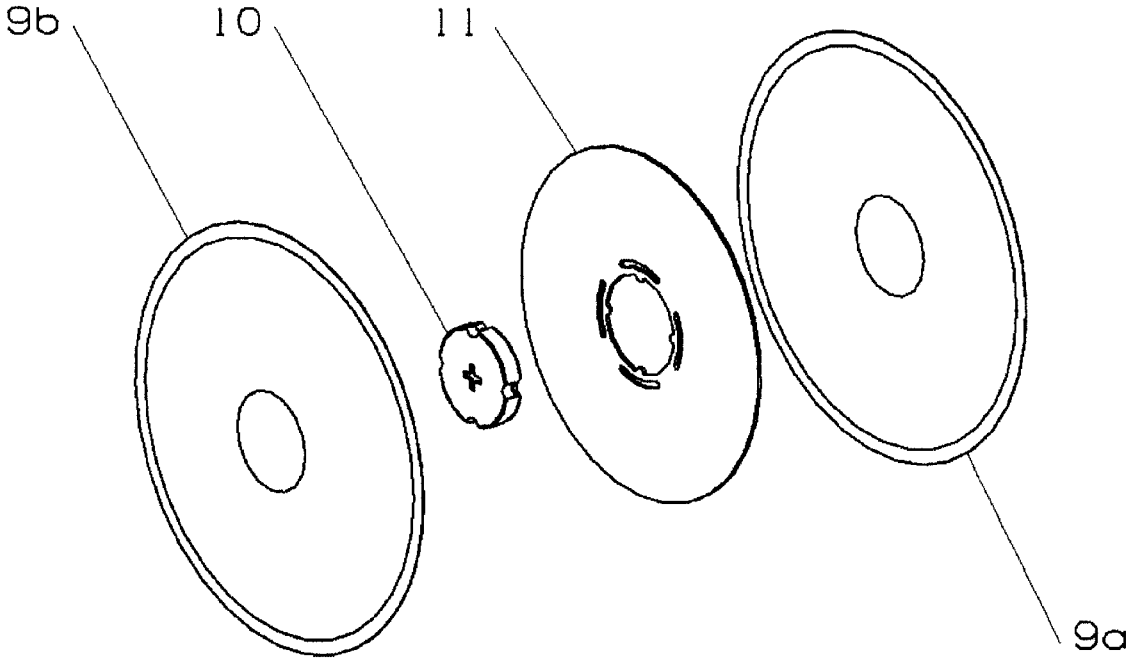
FIGS. 5*a* and 5*b* are perspective views of the unassembled components of the plastic disks shown in FIGS. 3*a* and 3*b* respectively.
Figure 5B:
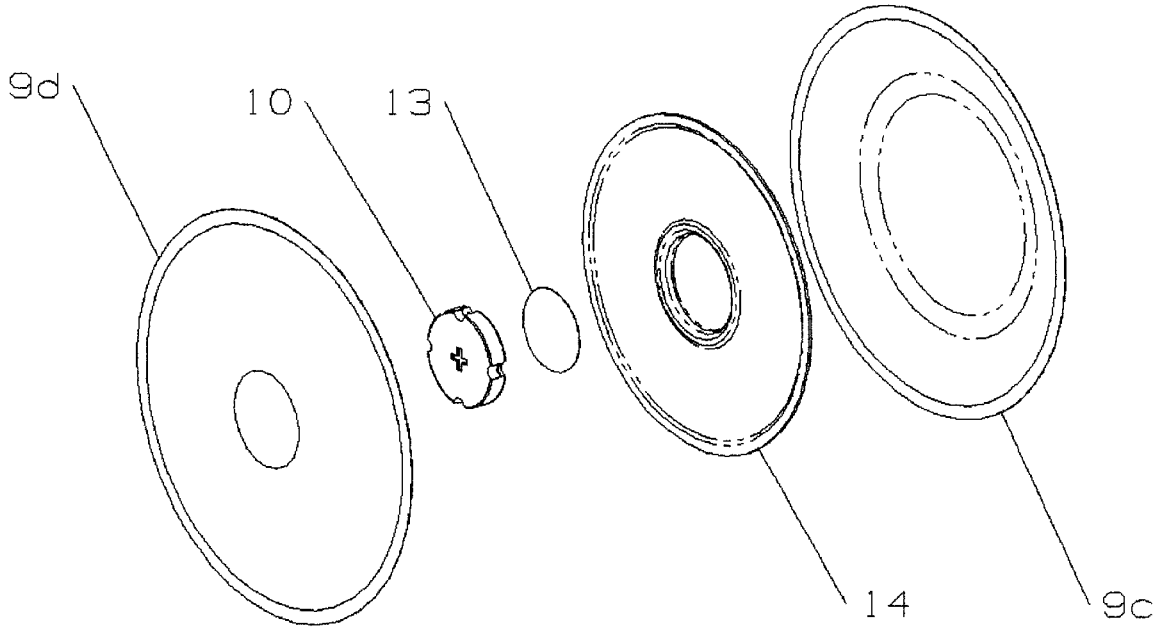

The structure of first plastic disk 8 is shown in FIGS. 3*a*, 4*a* and 5*a*. Magnet 10 is positioned in holder 11 which is encased between thin plastic sheets 9*a* and 9*b*. The plastic sheets are sealed together at their perimeters by heat or a suitable adhesive. The diameter of the disk may vary but, in keeping with safety considerations, it is at least large enough to protect against accidental swallowing by children. Disk 8 is thicker at its center than at its perimeter so that there is an upward incline from the perimeter to the center. This shape facilitates opening and closing of a shower curtain and the positioning of the entire assembly when the shower curtain is in its closed position.

Figure 3B:
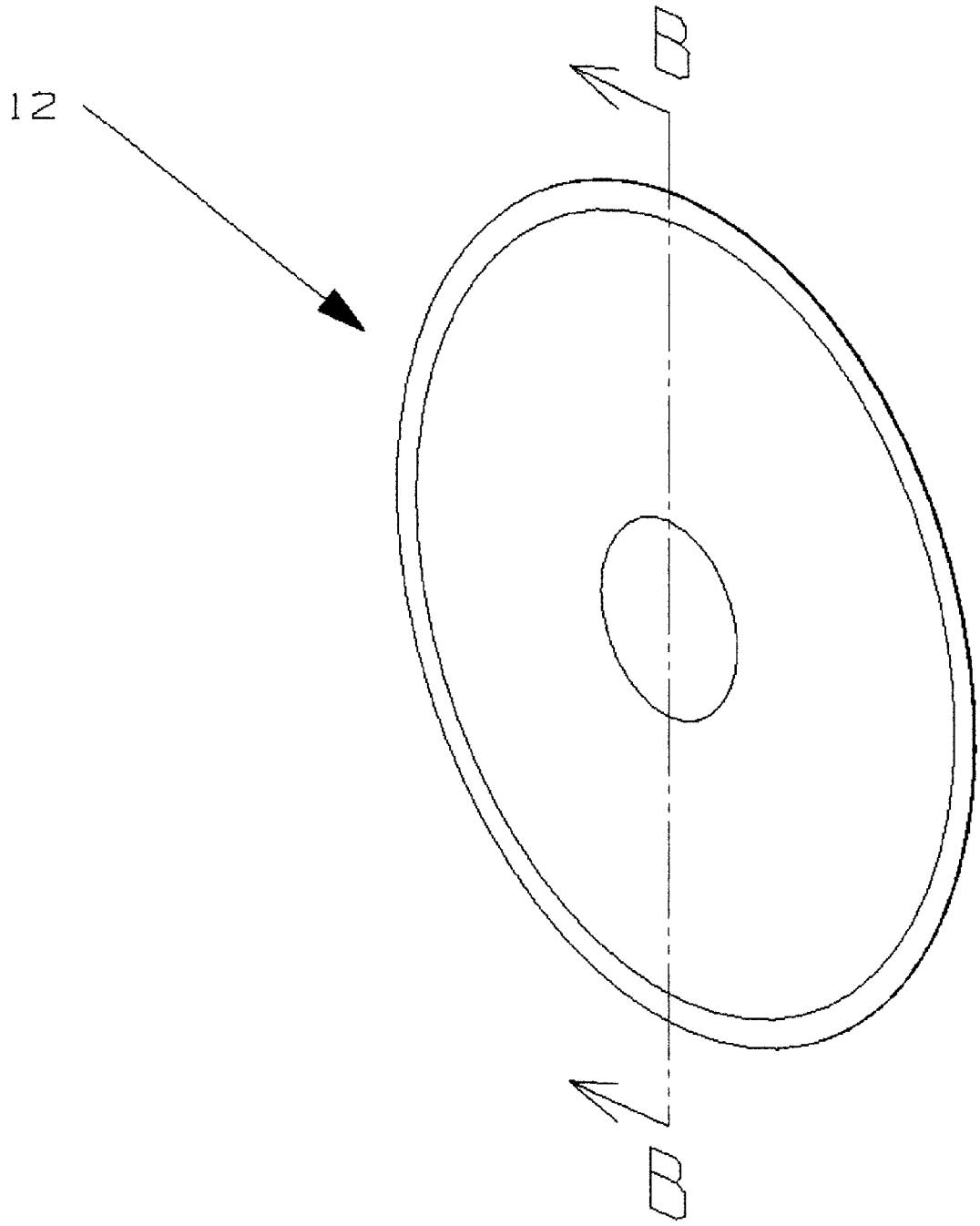

The structure of second plastic disk 12 is shown in FIGS. 3*b,* 4*b,* and 5*b*. Magnet 10 is positioned in a recess area at the center of disk shaped holder 14. Holder 14 includes a spacing element positioned between the periphery of the holder and the recess area. Plastic sheets 9*c* and 9*d* encase holder 14 in a manner such that sheet 9*c* extends from the edge of disk 12 over the spacing element and is sealed by heat or with an adhesive along its periphery to sheet 9*d*. Sheet 9*d* extends from the edge of disk 12 and over a surface of magnet 10 and is sealed along its periphery to sheet 9*c*. An adhesive bonding agent 13 which also serves as a magnetic shielding material, secures magnet 10 to holder 14. The spacing element causes magnet 10 to be offset so that it is closer to sheet 9*d* (front surface) than it is to sheet 9*c* (back surface). The offset position and the adhesive magnetic shielding material cause the magnetic force at the front surface to be greater than the magnetic force at the back surface. While the configuration of plastic disk 12 differs from plastic disk 8, it too is shaped so that there is an upward incline from its periphery to its center to enhance opening and closing of a shower curtain and the positioning of the entire assembly. Moreover, while its dimensions may vary, plastic disk 12 is also large enough to protect against accidental swallowing by children.

Figure 6A:
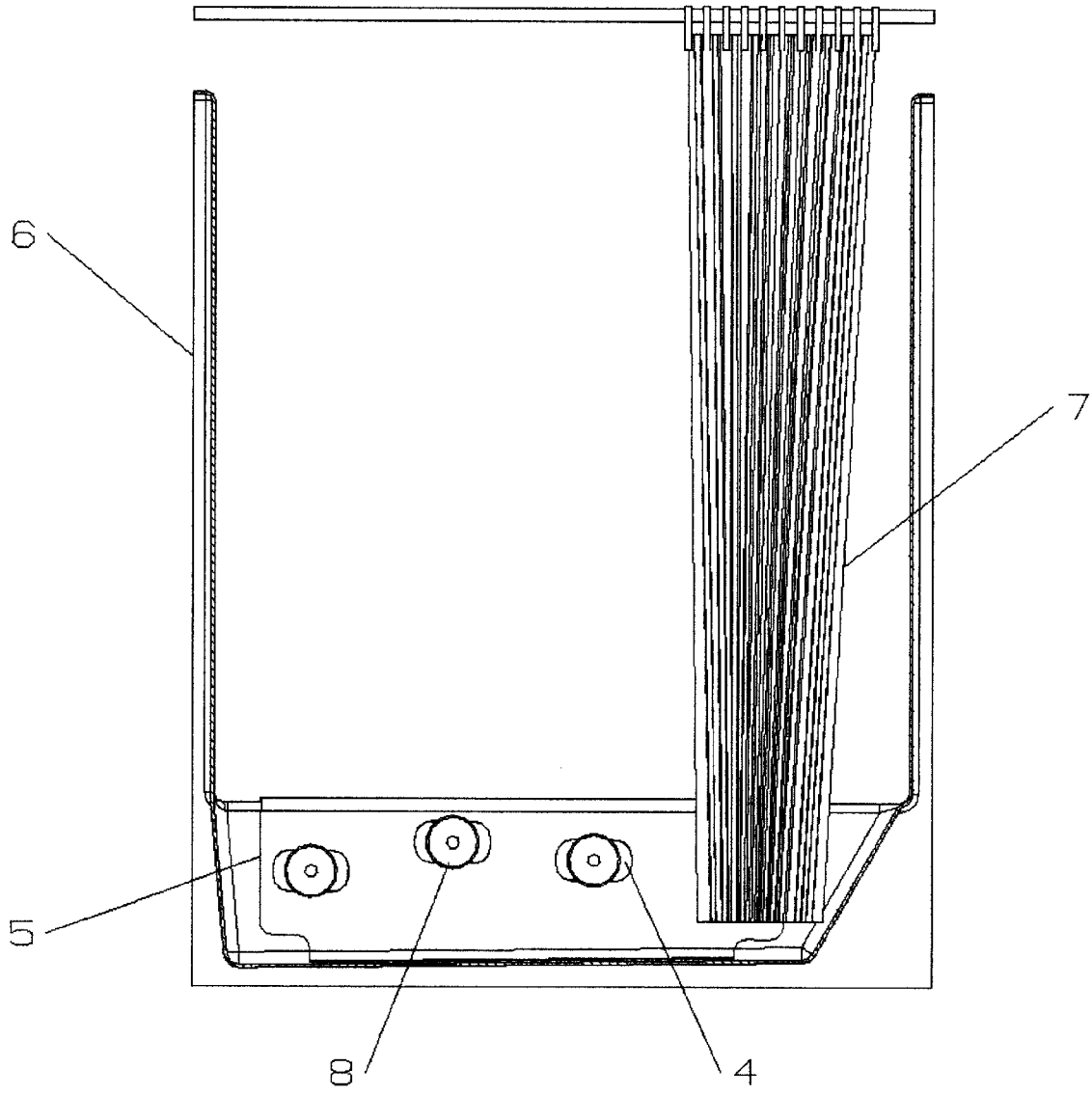
FIG. 6*a* is a rear plan cut away view of a shower enclosure showing a shower curtain in an open position.
Figure 6B:
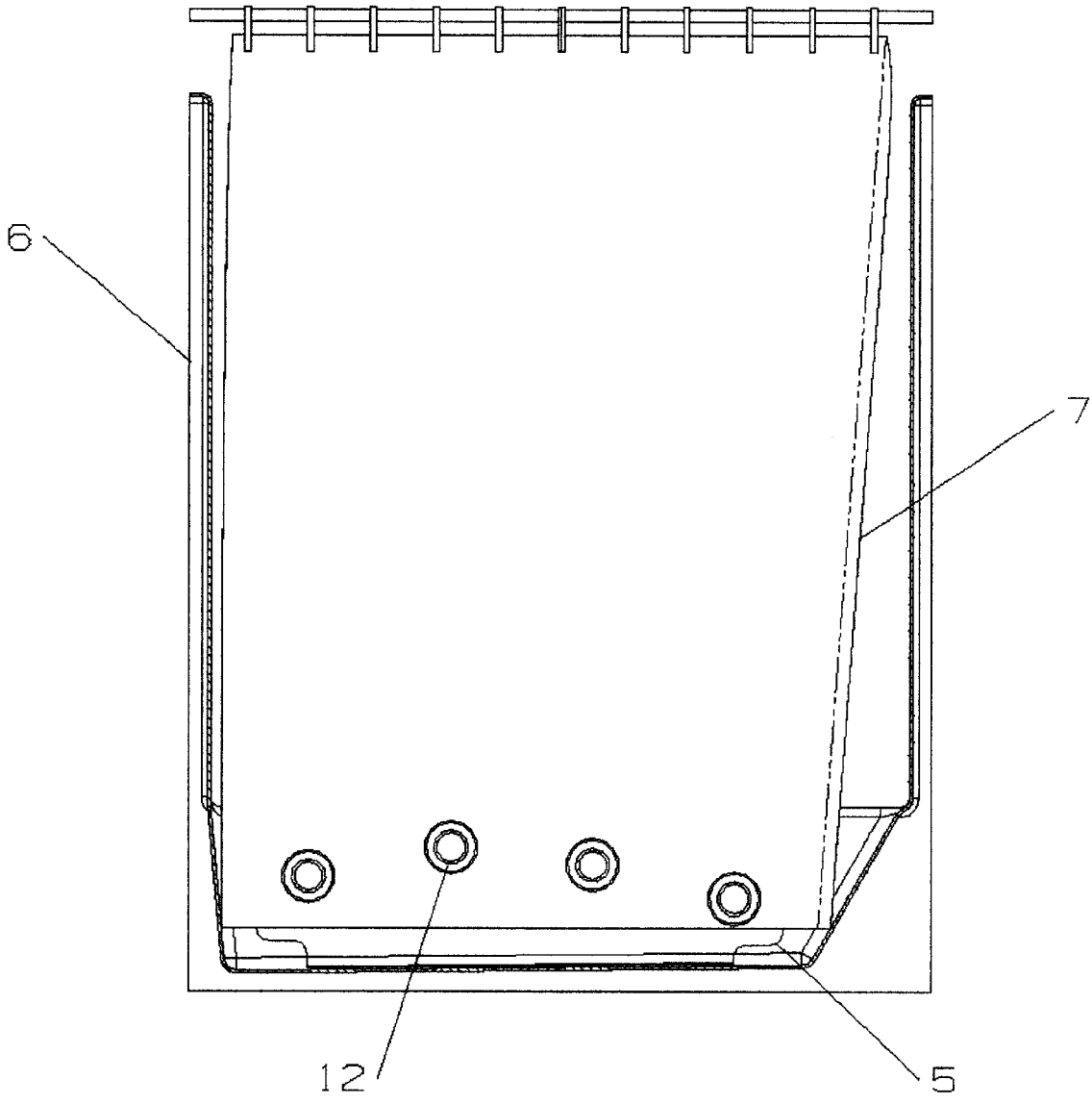
FIG. 6*b* is a rear plan cut away view of a shower enclosure showing a shower curtain in a closed position.
Figure 7:
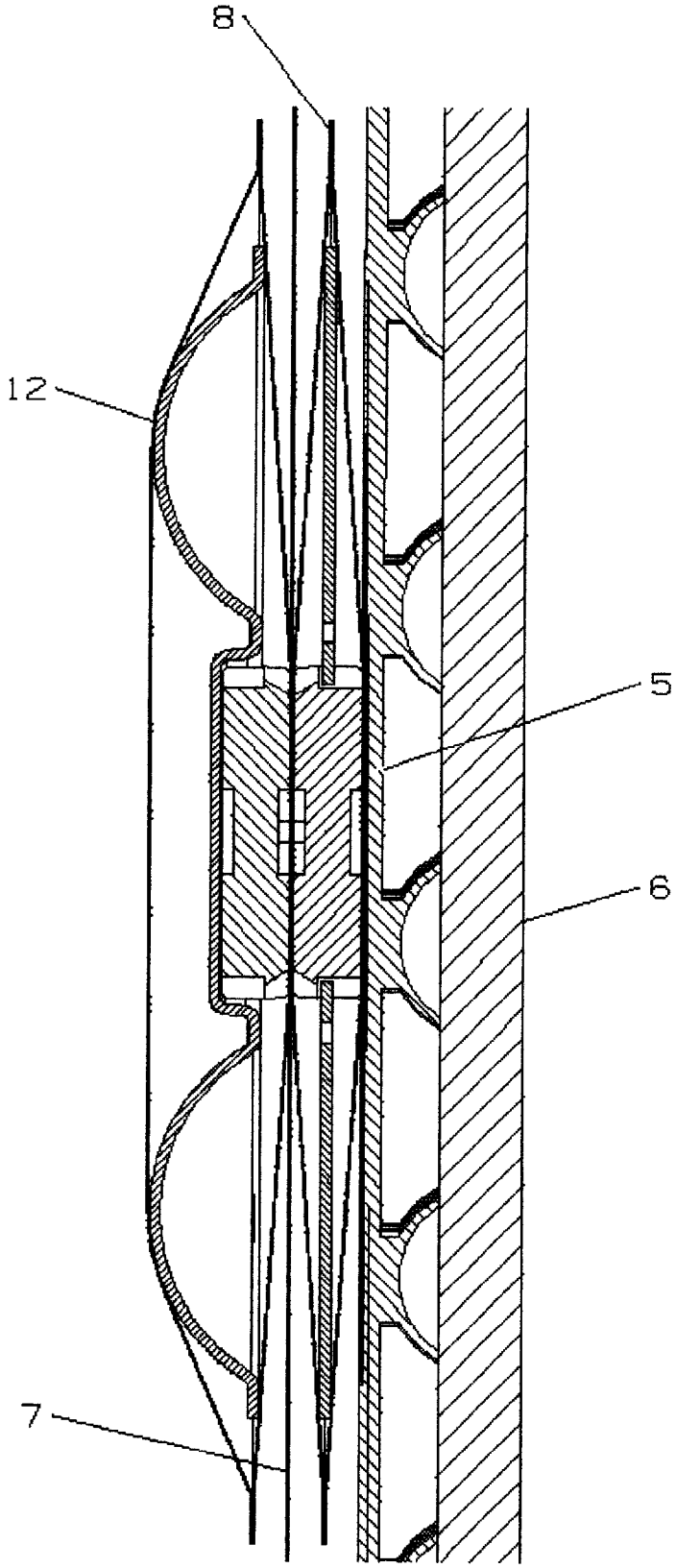
FIG. 7 is a sectional view of the shower curtain retainer assembly of this invention with a shower curtain in the closed position.
Figure 8:
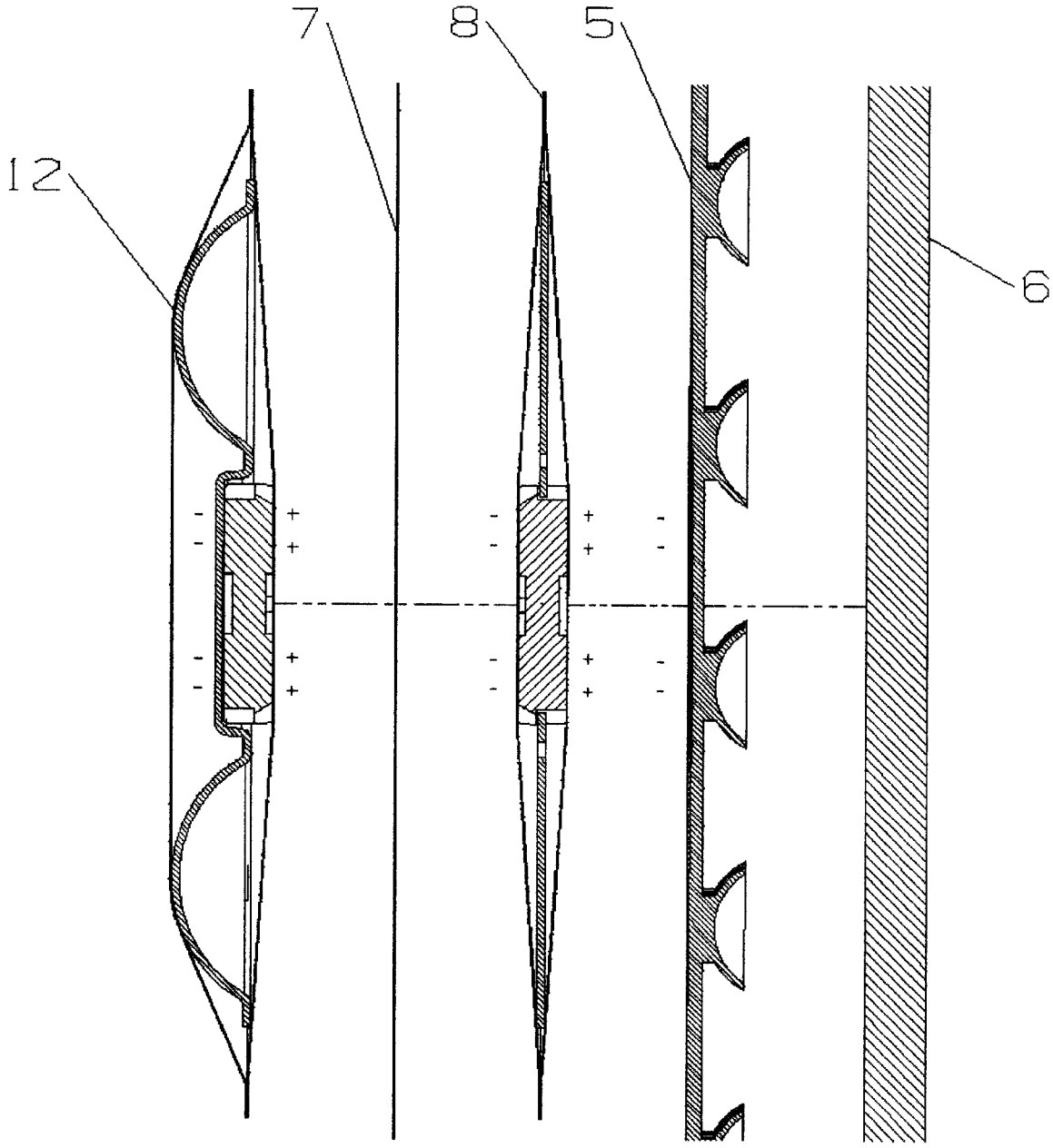
FIG. 8 is an exploded view of the assembly of FIG. 7.

Various ways may be used to assemble the parts for use with a shower curtain. In a preferred method, mat 5 with magnetically responsive plates attached thereto which are covered by cover 4 is attached to the inside wall of shower enclosure 6 as shown in FIG. 6*a*. With shower curtain 7 in its open position, a first plastic disk 8 is attached to each cover 4 of mat 5 and is held in place by magnetic attraction. Disk 8 is oriented so that the side with positive polarity is placed in contact with mat 5 at the location where a magnetically responsive plate is attached to the mat. Magnetically responsive plate 3 is oriented so that it has sufficient negative polarity at its surface to sustain the attachment disk 8. Shower curtain 7 is then placed in its closed position as shown in FIG. 6*b*. This places the outside face of curtain 7 adjacent to or in contact with mat 5 and mounted first plastic disk 8. With curtain 7 in the closed position, the front side of second plastic disk 12 which has a positive polarity, is manually held against the inside face of curtain 7 and aligned with the negative polarity side of a correspondingly positioned first plastic disk 8. When the alignment is completed, second plastic disk 12 is released but is maintained in position by forces of magnetic attraction with disk 8 as shown in FIGS. 7 and 8. It is understood that the positive and negative indications of polarity as shown in these figures are relative and may be reversed so long as the forces of attraction are maintained.

As curtain 17 is drawn to its open position, the pulling force applied upon opening is greater than the force of magnetic attraction between magnets encased in the first plastic disk 8 and magnetically responsive plates 3 attached to mat 7. This difference in forces causes separation of these parts. During the opening of curtain 7, first plastic disk 8 and second plastic disk 12 remain juxtapositioned with curtain 7 interposed between them. First plastic disk 8 remains attached to the juxtapositioned second plastic disk 12 rather than to plate 3 because the forces of magnetic attraction between disks 8 and 12 are greater than the forces of attraction between disk 8 and plate 3. Moreover, as previously explained, the attraction forces between disk 8 and plate 3 are overcome by the pulling force used to open the curtain.

While the description has focused on the use of one set of plastic disks and a corresponding magnetically attractive plate, the various figures show that the assembly of the invention is comprised of several sets of first plastic disks, second plastic disks and magnetically responsive plates. Each set is positioned so that it is mateable with another set.

After the assembly is in place, curtain 7 may be drawn closed without interruption or obstruction caused by unwanted or premature contact between any parts. The offset position of magnet 10 in disk 12 and the magnetic shielding material 13 prevent the back of disk 12 from becoming magnetically attached to the front (i.e. positive polarity) side of disk 8 either while curtain 7 is open or while it is being drawn closed. The inclined surfaces of the plastic disks ensure a smooth closure since the shape of their surfaces allows them to glide over obstructions that may be on the inside wall of the shower enclosure and in the travel of the curtain. When the curtain reaches its terminal closed position, the magnetic attraction between the various parts of the assembly serves to lock corresponding parts of the assembly with the shower curtain captured between the plastic disks and the magnetically responsive plates. The curtain is held firmly in place thereby precluding any air currents from blowing it against the body of an individual during use. The anchoring of the bottom of the curtain against the shower enclosure wall also prevents water from escaping from the shower enclosure onto an adjacent floor outside of the enclosure.

The invention has been described in detail with particular reference to certain preferred embodiments thereof, but it will be understood that variation and modification can be effected within the spirit and scope of the invention.

I claim:

1. An assembly for retaining a shower curtain in contact with a shower enclosure wall comprising:

a) a mat having a face surface, a said rear surface and magnetically responsive plates attached to said face surface wherein said rear surface includes means for attaching said mat to said shower enclosure wall;

b) a first set of plastic disks, each of said disks having a front surface comprised of a plastic material, a back surface comprised of plastic material and a magnet encased between said front and back surfaces in a manner such that said surfaces have opposite polarities, said first set of plastic disks being magnetically attachable to the magnetically responsive plates attached to the face surface of said mat; and c) a second set of plastic disks, each having a front surface, a back surface and a magnet encased between said front and back surfaces in a manner such that said surfaces have opposites polarities, said second set of plastic disks being magnetically mateable with said first set of plastic disks;

wherein the magnetic attraction force between said first and second set of plastic disks is greater than the magnetically attraction force between said first set of plastic disks and the magnetically responsive plates attached to the surface of said mat.

2. The assembly of claim 1 wherein the rear surface of said mat contains suction cups position thereon.

3. The assembly of claim 1 wherein the rear surface of said mat is attached to the shower enclosure wall, said first set of plastic disks is magnetically attached to the front surface of said mat, said second set of plastic disks is magnetically mated with said first set of plastic disks and a shower curtain is interposed between said first and second sets of plastic disks.

4. The assembly of claim 1 in which the front surface and back surface of each of said plastic disks are sealed together at their perimeters with said magnet encased therein.

5. The assembly of claim 1 in which the surfaces of each plastic disk in said first set are inclined upward from the perimeter toward the center of said disk.

6. The assembly of claim 1 in which the magnet encased in each disk in the second set of plastic disks is positioned in closer proximity to the front surface than to the back surface so that the magnetic force is greater at the front surface than at the back surface.

7. The assembly of claim 1 in which a magnetic shielding material is positioned between the magnet and the back surface so that the magnetic force is greater at the front surface than at the back surface.

8. The assembly of claim 1 wherein rear surface of said mat contains suction cups positioned thereon for attaching said mat to the bottom of a shower enclosure and for attaching said mat to said shower enclosure wall.

* * * * *